US006828939B2

(12) United States Patent
Li

(10) Patent No.: US 6,828,939 B2
(45) Date of Patent: Dec. 7, 2004

(54) MULTI-BAND ANTENNA

(75) Inventor: Nan-Lin Li, Tao-Yuan Hsien (TW)

(73) Assignee: Ain Comm.Technology Co., Ltd., Taipei (TW)

( * ) Notice: Subject to any disclaimer, the term of this patent is extended or adjusted under 35 U.S.C. 154(b) by 25 days.

(21) Appl. No.: 10/391,218

(22) Filed: Mar. 18, 2003

(65) Prior Publication Data

US 2004/0075609 A1 Apr. 22, 2004

(30) Foreign Application Priority Data

Oct. 16, 2002 (TW) ..... 91123878 A

(51) Int. Cl.[7] ..... H01Q 1/38; H01Q 1/00; H01Q 13/00

(52) U.S. Cl. ..... 343/700 MS; 783/729

(58) Field of Search ..... 343/700 MS, 729, 343/783, 793, 795; H01Q 1/38, 1/00, 13/00

(56) References Cited

U.S. PATENT DOCUMENTS 6,339,404 B1 * 1/2002 Johnson et al. ..... 343/794
6,476,769 B1 * 11/2002 Lehtola ..... 343/702
6,552,686 B2 * 4/2003 Ollikainen et al. .. 343/700 MS
6,650,294 B2 * 11/2003 Ying et al. ..... 343/700 MS

* cited by examiner

*Primary Examiner*—Shih-Chao Chen
*Assistant Examiner*—Trinh Vo Dinh
(74) *Attorney, Agent, or Firm*—Seyfarth Shaw LLP

(57) ABSTRACT

The present invention reveals a multi-band antenna comprising a dielectric plate, a first metal foil and two second metal foils, where the first metal foil and the second metal foils are adhered to a surface of the dielectric plate. The first metal foil comprises a first plate, a second plate, two first stripes and a connecting bar, where the length of the first stripe is equivalent to one fourth wavelength of the first frequency used in the multi-band antenna, the connecting bar connects the center portions of the facing sides of the first plate and the second plate, the total length of the first plate, the second plate and the connecting bar is equivalent to one fourth wavelength of the second frequency used in the multi-band antenna. Each second metal foil comprises a second stripe and a third stripe, where the length of the second stripe is equivalent to one fourth wavelength of the second frequency used in the multi-band antenna, the length of the third stripe is equivalent to one fourth wavelength of the first frequency used in the multi-band antenna.

19 Claims, 10 Drawing Sheets

MULTI-BAND ANTENNA

BACKGROUND OF THE INVENTION (A) Field of the Invention

The present invention is related to an antenna, more specifically, to a multi-band antenna.

(B) Description of Related Art

With the development of wireless communication, cellular phones and WLAN (Wireless Local Area Network) are becoming necessities for current communication. Various types and categories of antennas of WLAN apparatuses and cellular phones for signal receiving and transmitting are well developed in an attempt to cover wider radiation range, achieving better signal receiving and transmitting performance. Furthermore, antennas are designed to be smaller for portable requirement and installation space concern.

ISM (Industrial, Science and Medical) band is a free worldwide public band, of which the ranges are at frequency of 900 MHz, 2.4 GHz and 5 GHz. The range of 2.4 GHz RF (Radio Frequency) band is limited between 2.4–2.8435 GHz, which is overloaded at the present.

In order to achieve superior communication quality and stability, the new wireless communication protocol U-NII of 802.11a (47CFR15.401) additionally provides a band around 5 GHz for usage, in which the band of 5.150–5.250 GHz is used for radiation power below 50 mW, the band of 5.250–5.350 GHz is used for radiation power below 250 mW, and the band of 5.725–5.825 GHz is used for radiation power below 1000 mW. Communication protocol ISM of 802.11a (47CFR15.247) designates that 5.725–5.825 GHz is used for radiation power below 1000 mW. The above described wavelengths of wireless radio wave are between 51.30–58.25 mm. Furthermore, 802.11b/g ISM (47CFR15.247) designates that the band of 2.400–2.4835 GHz is used for radiation power below 1000 mV, and the wavelengths of wireless radio wave are between 120.7–125 mm.

Because widely used bands of 2.4 GHz and 5 GHz are not in double frequency resonant relation, if an antenna uses bands of 2.4 GHz and 5 GHz, the design is more difficult than that of a dual-band cellular phone using 900 MHz and 1800 MHz.

SUMMARY OF THE INVENTION

The object of the present invention is to provide a multi-band antenna, especially, for a WLAN apparatus, which occupies less space and has a capability of being used in various bands. By using multi-band antenna in current WLAN apparatuses, the WLAN apparatuses can be used in various bands regulated by different protocols without antenna change.

The multi-band antenna of the present invention comprises a dielectric plate, a first metal foil and two second metal foils, where the first metal foil and the second metal foils are adhered to a surface of the dielectric plate. The first metal foil comprises a first plate, a second plate, two first stripes and a connecting bar, the second plate including a first signal-fed point, the two first stripes being electrically connected to the first signal-fed point and symmetric along the second plate, the longitudinal direction of the first stripe being designated as a first direction. Each first stripe is spaced at a distance to the second plate, and the length of each first stripe is equivalent to one fourth wavelength of the first frequency used in the multi-band antenna. The connecting bar connects the centers of the facing sides of the first plate and the second plate. The longitudinal direction of the structure constituted of the first plate, the connecting bar and the second plate is along the first direction, and the total length of the first plate, the second plate and the connecting bar is equivalent to one fourth wavelength of the second frequency used in the multi-band antenna. The two second metal foils are symmetric along the first direction and are spaced according to the first metal foil along a second direction that is perpendicular to the first direction. Each second metal foil comprises a second stripe and a third stripe, where the second stripe may electrically connect to a second signal-fed point, whose longitudinal direction is in the first direction, and the length of the second stripe is equivalent to one fourth wavelength of the second frequency used in the multi-band antenna. The third stripe may electrically connect to the second signal-fed point, whose longitudinal direction is in the first direction, and the length of the third stripe is equivalent to one fourth wavelength of the first frequency used in the multi-band antenna.

For instance, the first frequency is within ISM 5 GHz band, and the second frequency is within ISM 2.4 GHz band.

The multi-band antenna can be installed in a notebook computer as a wireless signal receiving and transmitting apparatus. If an access point of a company uses ISM 2.4 GHz band, and that of another company uses ISM 5 GHz band, the multi-band antenna can be used to meet the different requirements of the different communication protocols for wireless network data transmission between these two companies.

DETAILED DESCRIPTION OF THE INVENTION

Figure 1:
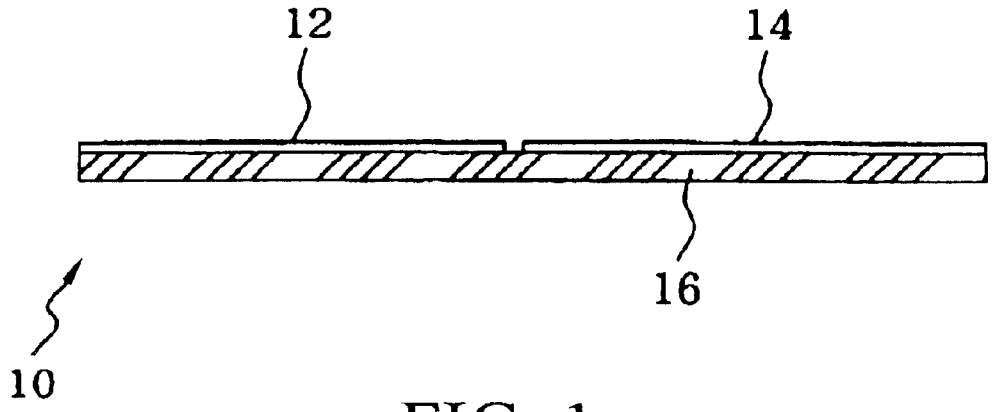
FIG. 1 is a side view of the multi-band antenna of the present invention.

FIG. 1 is a side view of the multi-band antenna 10 of the present invention, in which a first metal foil 12 and two second metal foils 14 are adhered to a dielectric plate 16, and a spacing is between the first metal foil 12 and the two second metal foils 14. The thickness of the dielectric plate 16 is between 0.3–0.5 mm, and the total thickness of the first metal foil 12 and the second metal foils 14 is between 0.025–0.03 mm.

Figure 2:
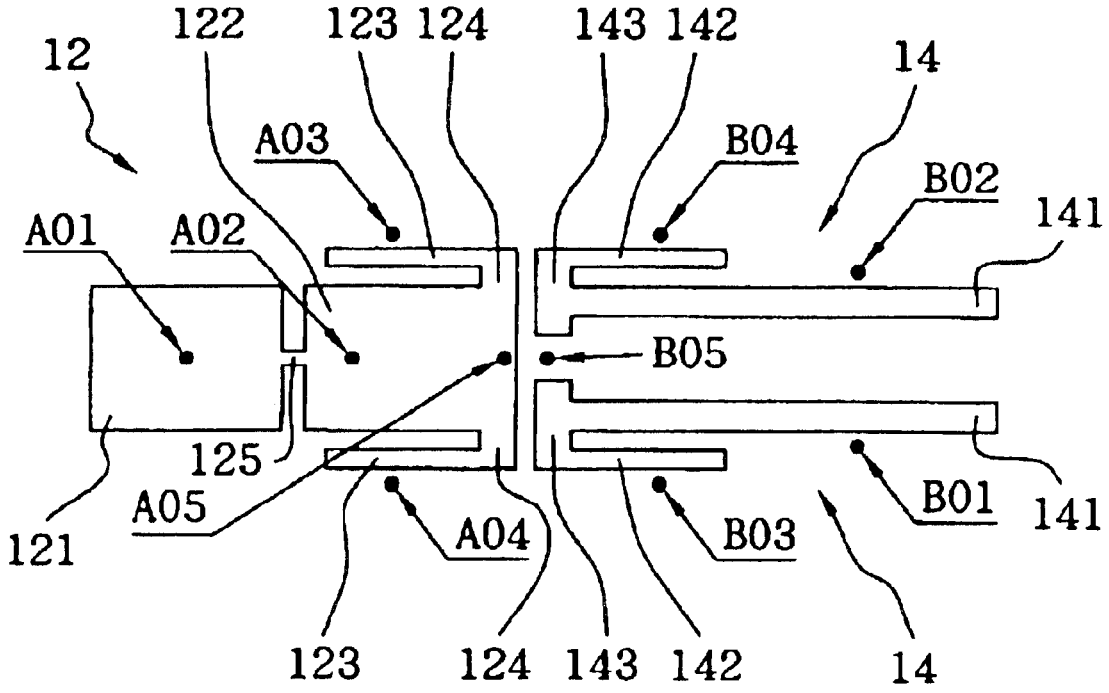
FIG. 2 illustrates the top view of the first metal foil and the second metal foil of the present invention.

FIG. 2 illustrates the top view of the first metal foil 12 and the second metal foils 14. The first metal foil 12 comprises a first plate 121, a second plate 122, two first stripes 123, two first connecting plates 124 and a connecting bar 125, where the connecting bar 125 connects the facing sides of the first plate 121 and the second plate 122. The longitudinal direction of the structure constituted of the first plate 121, the connecting bar 125 and the second plate 122 is designated as a first direction for clear description below. The two first stripes 123, whose longitudinal direction is along the first direction, are placed on the two sides of the second plate 122, and the ends close to the second metal foils 14 are individually connected to the two sides of the end of the second plate 122, closed to the second metal foils 14, by the two first connecting plates 124 to form a symmetric structure. Two openings formed by the first stripes 123, the first connecting plates 124 and the second plate 122 are the heading for the first plate 121, and the width of the opening, i.e., the spacing between the first stripe 123 and the second plate 122, is less than 2 mm.

A spacing less than 2 mm is between the first metal foil 12 and the second metal foils 14. The two second metal foils 14 are symmetric along the first direction, and each second metal foil 14 comprises a second stripe 141, a third stripe 142 and a second connecting plate 143. The longitudinal directions of the second stripe 141 and the third stripe 142 are along the first direction, and their ends are connected by the second connecting plate 143. The spacing between each second stripe 141 and each third stripe 142 is less than 2 mm.

The design of the multi-band antenna of the present invention is based on the half-wave dipole antenna technique, and thus the effective lengths of the first metal foil 12 and the second metal foils 14 are equivalent to one fourth wavelength of the frequency used. The horizontal dimensions of the components shown in FIG. 2 are designated as "lengths", and the vertical dimensions of that are designated as "widths" hereinafter for clear differentiation. The connecting bar 125 will induce an equivalent inductance when a signal is being transmitted. Because the higher the frequency, the greater the inductive reactance $2\pi fL$ (f is a frequency, and L is an inductance) if the multi-band antenna 10 for both ISM 2.4 GHz and 5 GHz bands uses a frequency of 5 GHz, the higher inductive reactance of the equivalent inductance resulted from the higher frequency will induce an open resonant effect between the first plate 121 and the second plate 122, i.e., the first plate 121 of the multi-band antenna 10 is not in use. The signal receiving and transmitting of the multi-band antenna 10 are positioned at A03, A04 and B03, B04 of FIG. 2, i.e., only the first stripes 123 and the third stripes 142 are in use. The width of the connecting bar 125, compared to the first plate 121 and the second plate 122, is limited to avoid too small equivalent inductance that may lower the open resonant effect. The width of the connecting bar 125 had better be less than one tenth of the width of the second plate 122, e.g., less than 1 mm in this embodiment.

In contrast, when the multi-band antenna 10 uses a frequency of ISM 2.4 GHz band, the lower inductive reactance resulted from the lower frequency will induce a close resonant effect at the connecting bar 125. Therefore, the effective length of the multi-band antenna 10 is equivalent to the total length of the first plate 121, the connecting bar 125 and the second plate 122, i.e., the entire length of the first metal foil 12, which is approximately equivalent to the length of the second stripe 141. The locations of signal receiving and transmitting of the multi-band antenna 10 are at A01, A02 and B01, B02 of FIG. 2. The lengths of the first metal foil 12 and the second stripe 141 can be derived by the following Eg. (1)

$$\lambda = \frac{c}{f * \sqrt{\varepsilon_r}} \tag{1}$$

where λ is a wavelength;

c is the light speed, i.e., $3\times10^{11}$ mm;

f is a frequency; and $\in_r$ is the dielectric constant of the dielectric plate 16.

If f is 2.4 GHz and the dielectric constant $\in_r$ of the dielectric plate 16 is 1.69, one fourth wavelength of the frequency of 2.4 GHz calculated by Eq. (1) is approximate 24 mm, which is both the length of the second stripe 141 and the total length of the first plate 121, the connecting bar 125 and the second plate 122. Because the geometry of the structure of first plate 121, the connecting bar 125 and the second plate 122 is different from that of the second stripe 141, their $\in_r$ may be different, causing slight different lengths between them.

If f is 5.25 GHz and the dielectric constant $\epsilon_r$ of the dielectric plate 16 is 1.69, one fourth wavelength of the frequency of 5.25 GHz calculated by Eq. (1) is approximate 11 mm, which is equivalent to the lengths of the first stripe 123 and the third stripe 142.

The second plate 14 comprises a first signal-fed point A05 for signal receiving and transmitting of the first metal foil 12, and a second signal-fed point B05 is interposed between the two second stripes 141 for signal receiving and transmitting of the second metal foils 14.

Figure 3:
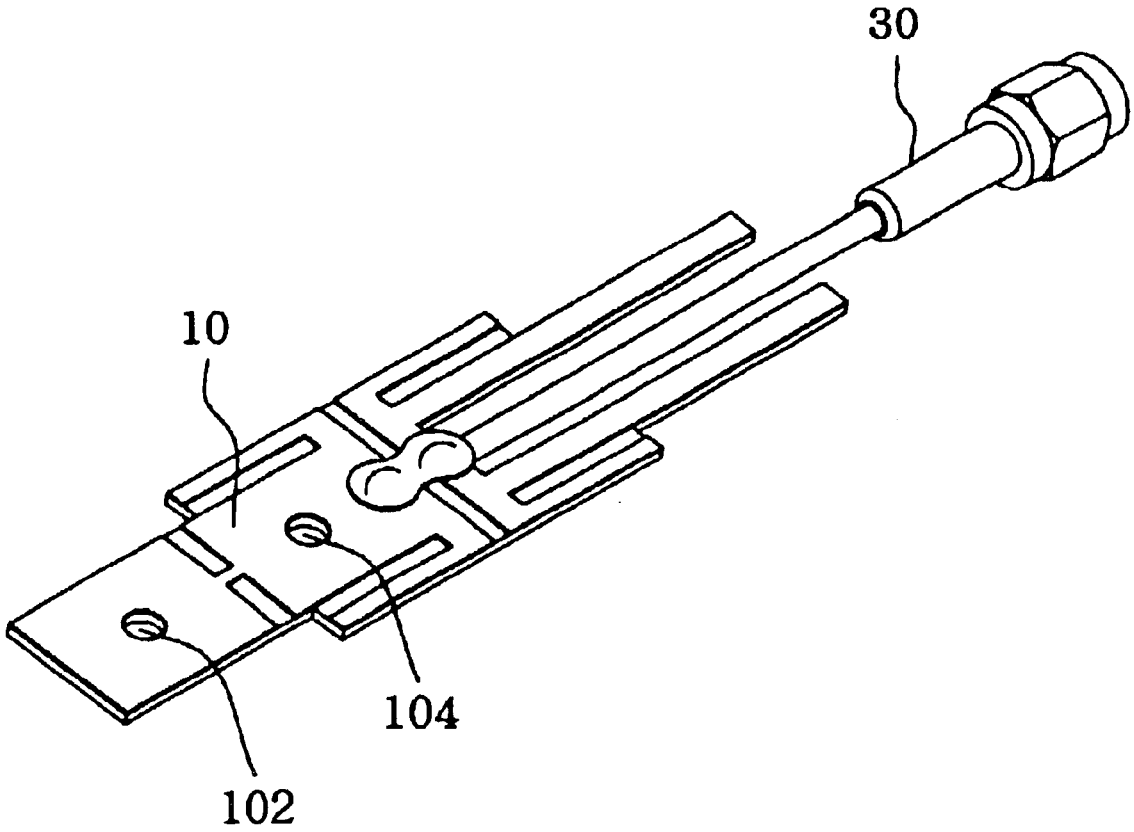
FIG. 3 illustrates the combination of the multi-band antenna of the present invention and the wires.

Referring to FIG. 3, a lead 30 is electrically connected to both the first signal-fed point A05 and the second signal-fed point B05, the spacing between the two second metal foils 14 is to accommodate the lead 30. The first plate 121 and the second plate 122 of the multi-band antenna 10 can further comprise two fixing holes 102, 104 for installation.

The first metal foil 12 and the second metal foils 14 can be composed of copper, gold or the like. The dielectric coefficient $\in_r$ of the dielectric plate 16 is between 1 to 4.55, which can be made of glass fiber, e.g., FR-4.

Figure 4A:
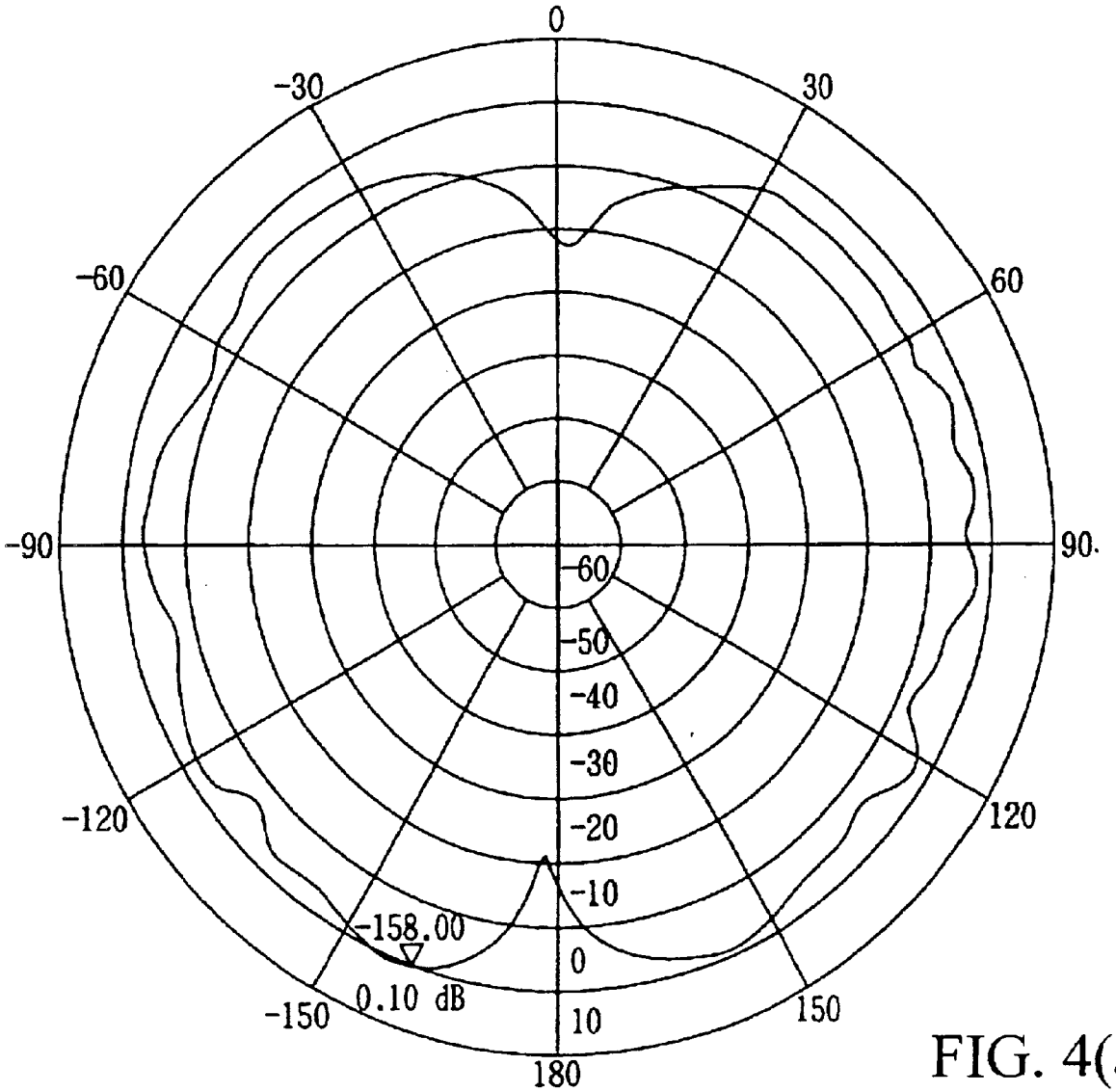
FIG. 4(*a*) and FIG. 4(*b*) are the radiation diagrams of the multi-band antenna of the present invention used at 2.4 GHz.
Figure 4B:
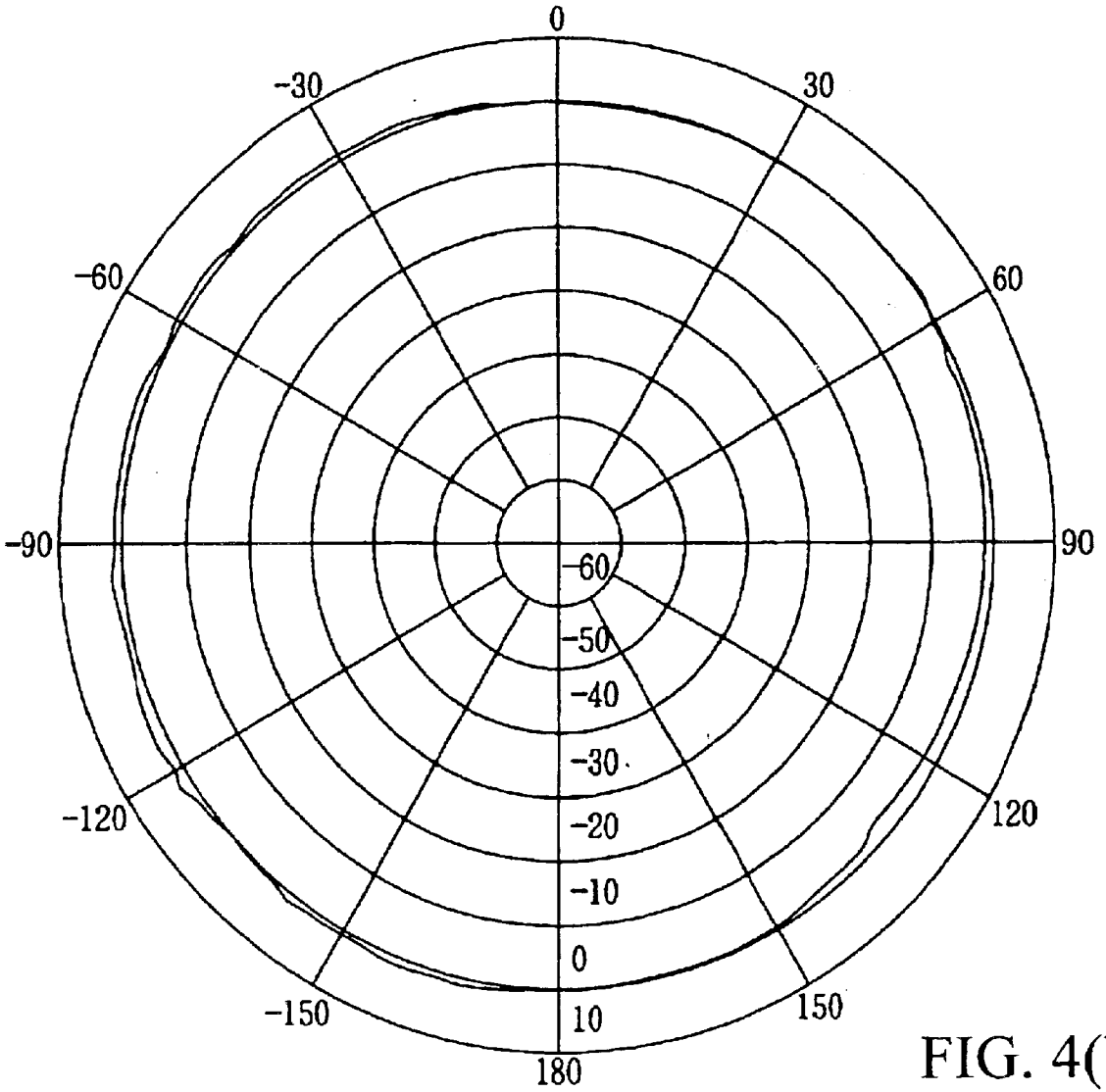
Figure 5A:
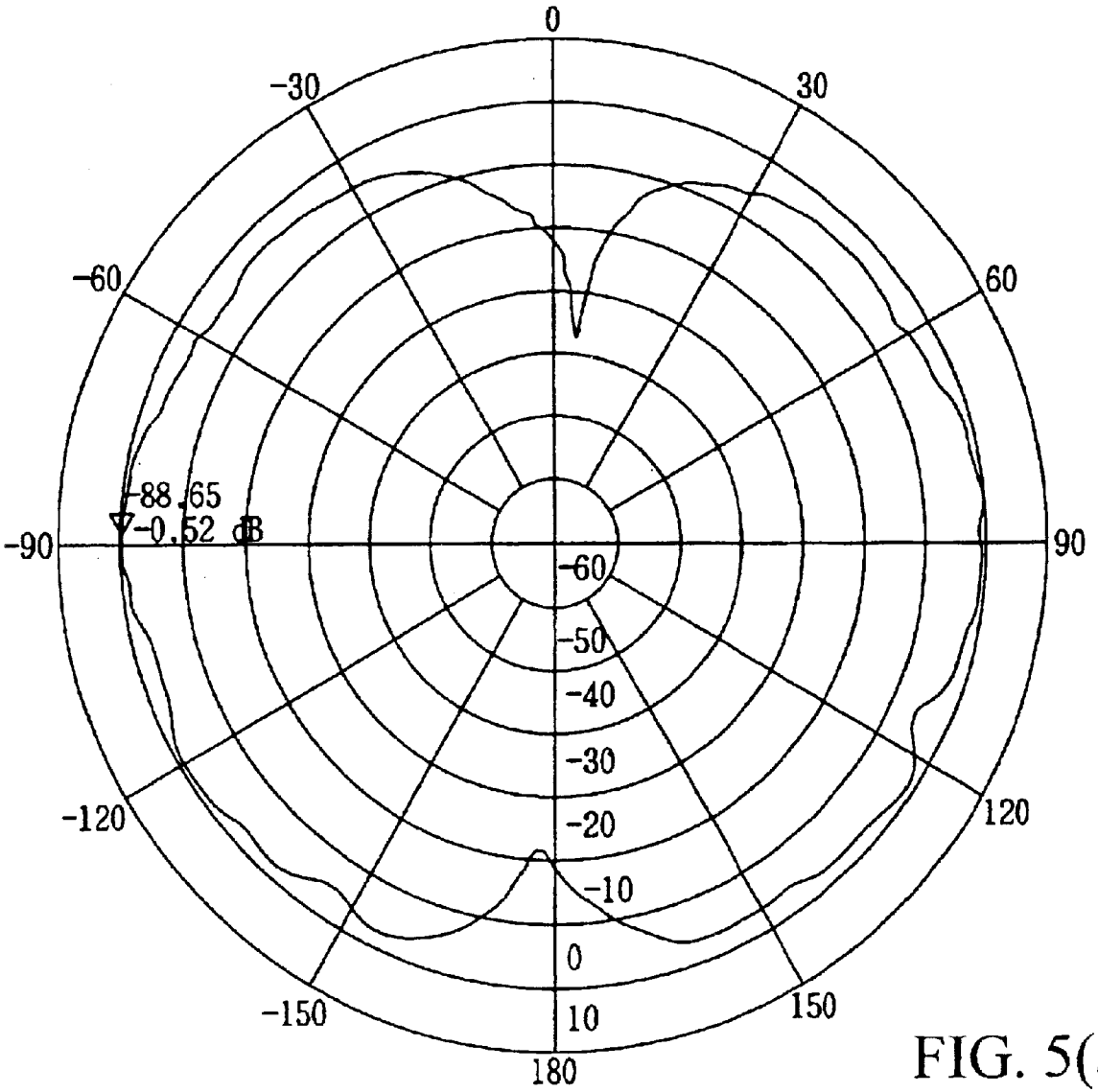
FIG. 5(*a*) and FIG. 5(*b*) are the radiation diagrams of the multi-band antenna of the present invention used at 2.5 GHz.
Figure 5B:
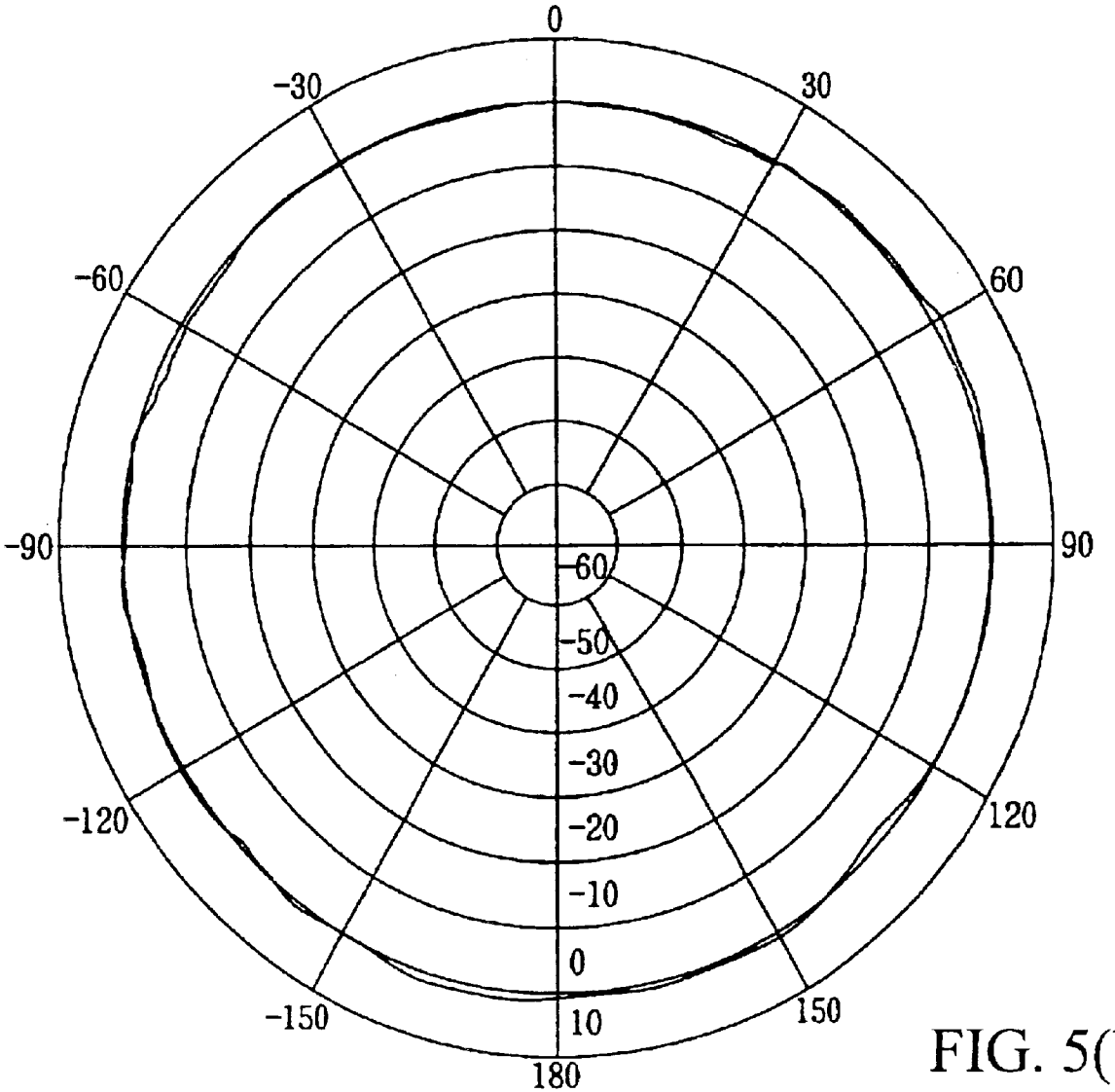
Figure 6A:
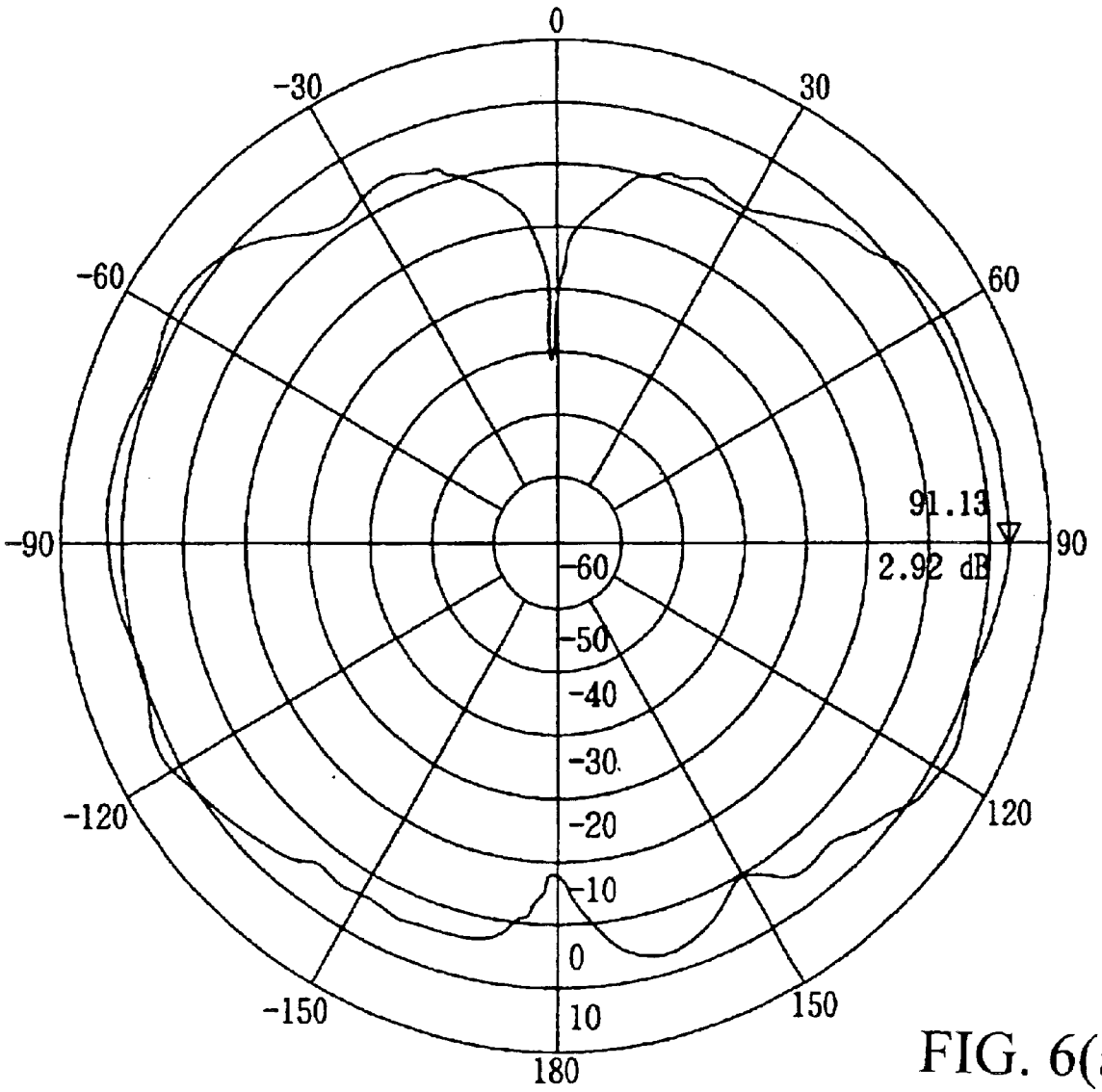
FIG. 6(*a*) and FIG. 6(*b*) are the radiation diagrams of the multi-band antenna of the present invention used at 5.25 GHz.
Figure 6B:
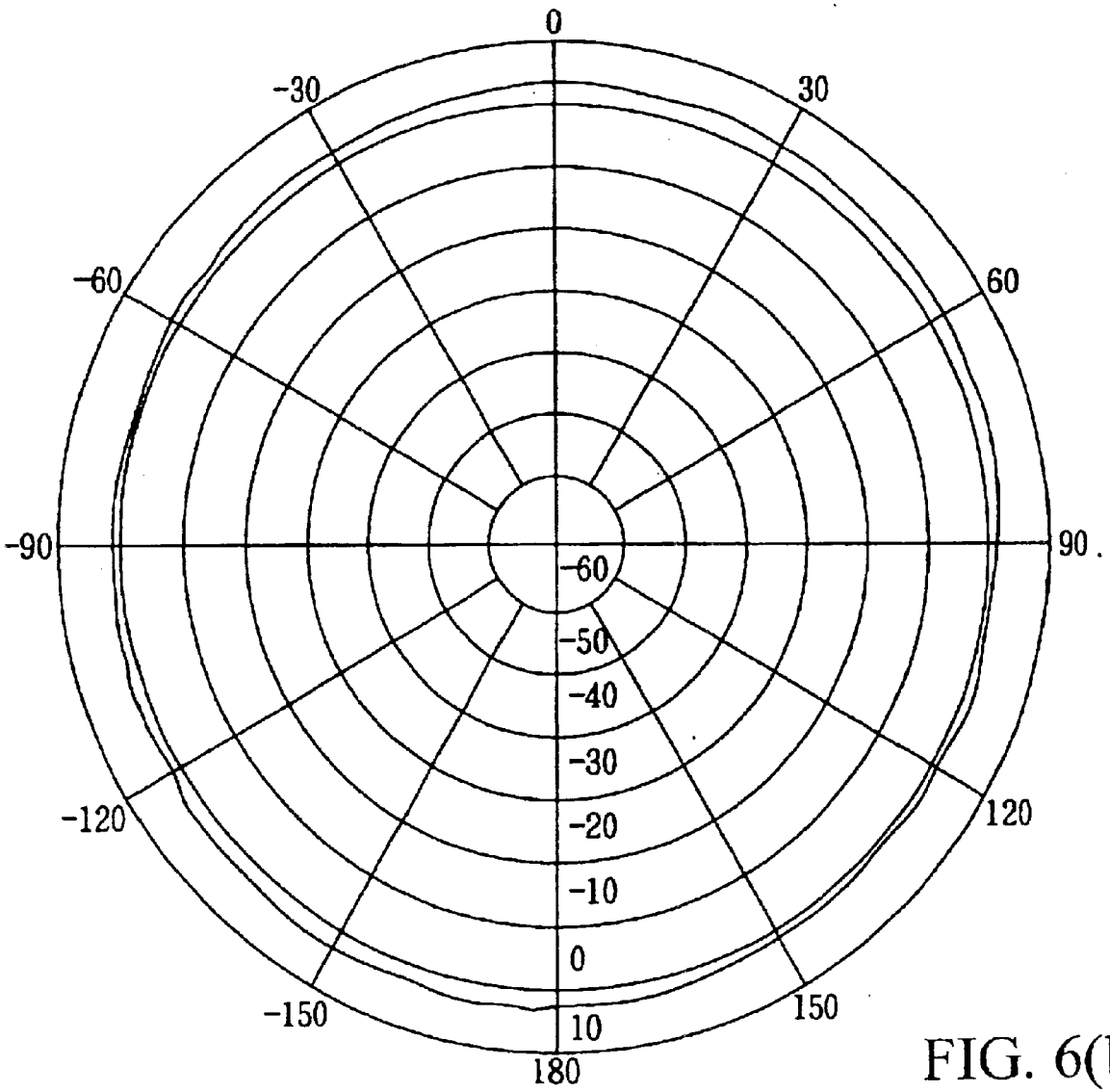
Figure 7A:
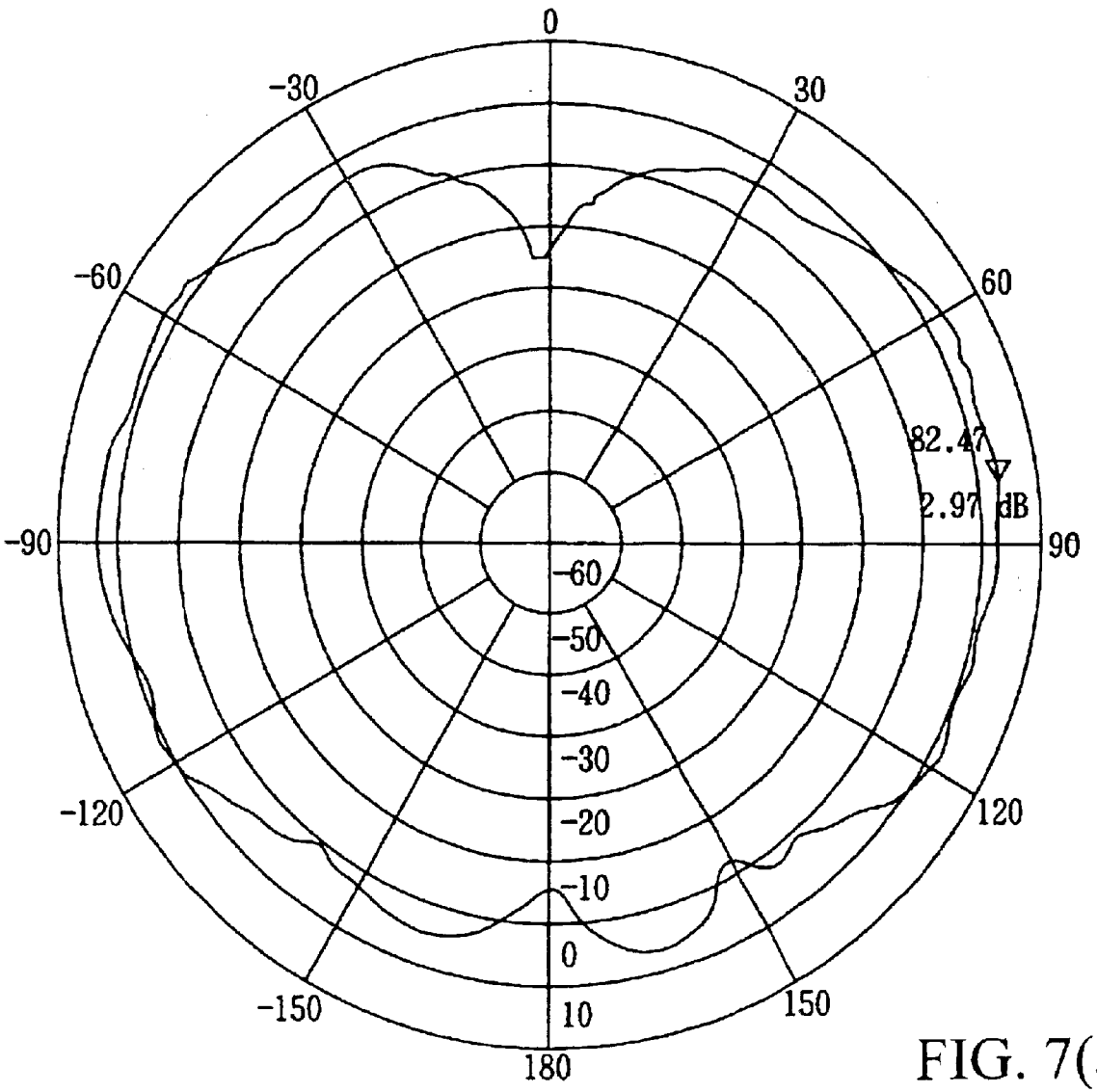
FIG. 7(*a*) and FIG. 7(*b*) are the radiation diagrams of the multi-band antenna of the present invention used at 5.5 GHz.
Figure 7B:
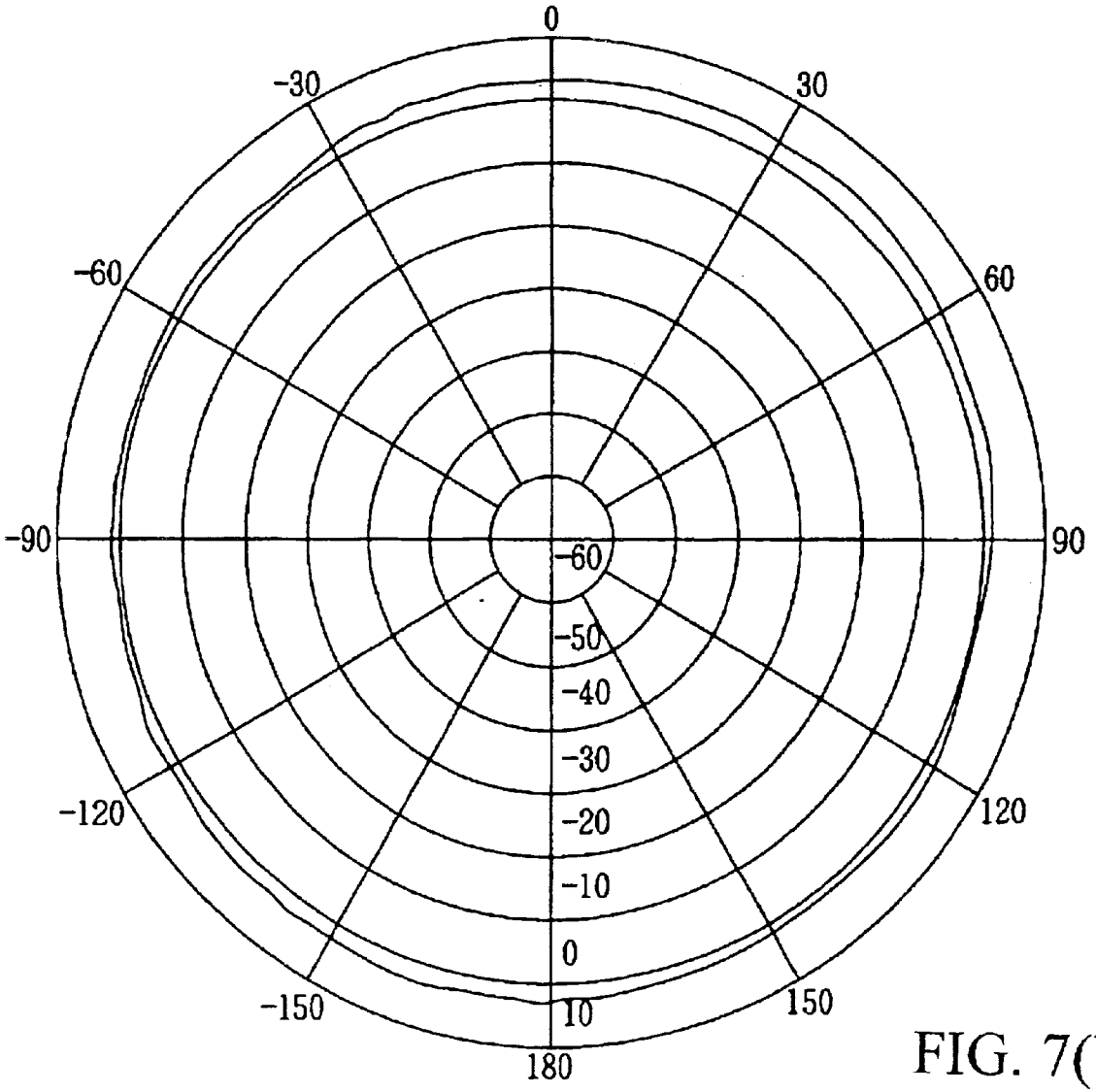

FIG. 4(*a*), FIG. 5(*a*), FIG. 6(*a*) and FIG. 7(*a*) respectively show the radiation diagrams of the multi-band antenna 10 at 2.4 GHz, 2.5 GHz, 5.25 GHz and 5.5 GHz. In such cases, the multi-band antenna 10 lies on the plane of each diagram, and the radiation unit is dBi.

FIG. 4(*b*), FIG. 5(*b*), FIG. 6(*b*) and FIG. 7(*b*) respectively show the radiation diagrams of the multi-band antenna 10 at 2.4 GHz, 2.5 GHz, 5.25 GHz and 5.5 GHz. In such cases, the multi-band antenna is placed vertically to the plane of each diagram, and the radiation unit is dBi.

In view of the diagrams at different frequencies, the multi-band antenna 10 is an omni antenna that performs excellently at various frequencies.

Although the embodiment employs simple rectangular and elongated components to form the multi-band antenna, they can be made in other forms, e.g., the first stripes 123 and the third stripes 142 are in waveform so long as the effective lengths is equivalent to one fourth wavelength of the frequency used.

As described in the "Background of the Invention", ISM 5 GHz band can be divided into three sub-bands. The multi-band antenna 10 can use ISM 5 GHz band, i.e., which can meet the requirement of multi-band communication, so named "multi-band antenna."

The above-described embodiment of the present invention are intended to be illustrative only. Numerous alternative embodiments may be devised by those skilled in the art without departing from the scope of the following claims.

What is claimed is:

1. A multi-band antenna having a first frequency and a second frequency substantially lower than the first frequency, the multi-band antenna comprising:

(a) a dielectric plate;

(b) a first metal foil disposed on a surface of the dielectric plate, comprising:

a first plate;

a second plate including a first signal-fed point;

two first stripes wherein the length of each stripe is equivalent to one fourth wavelength of the first frequency;

two first connecting plates for connecting the two first stripes and the second plate; and a connecting bar for connecting the first plate and the second plate, and the total length of the first plate, the connecting bar and the second plate being equivalent to one fourth wavelength of the second frequency; and (c) two second metal foils disposed on the surface of the dielectric plate and spaced at a distance to the first metal foil, each of the second metal foils comprises:

a second stripe whose length is equivalent to one fourth wavelength of the second frequency;

a third stripe whose length is equivalent to one fourth wavelength of the first frequency; and a second connecting plate for connecting the second stripe and the third stripe.

2. The multi-band antenna of claim 1, wherein one of the first connecting plates is used to connect one side of the second plate and one end of the first stripe so that the periphery of the first stripe, the first connecting plates and the second plate forms an opening heading for the first plate.

3. The multi-band antenna of claim 1, wherein one end of the second connecting plate is electrically connected to a second signal-fed point.

4. The multi-band antenna of claim 1, wherein the first frequency is within ISM 5 GHz band, and the second frequency is within ISM 2.4 GHz band.

5. The multi-band antenna of claim 1, wherein one fourth wavelengths of the first and the second frequencies are calculated by the following equation $$\lambda = \frac{c}{f * \sqrt{\varepsilon_r}},$$

where λ represents the wavelength;

c represents the light speed;

f represents one of the first and the second frequencies; and $\in_r$ represents a dielectric constant of the dielectric plate.

6. The multi-band antenna of claim 1, wherein the width of the connecting bar is less than 1 mm.

7. The multi-band antenna of claim 1, wherein the width of the connecting bar is less than one tenth of the width of the second plate.

8. The multi-band antenna of claim 1, wherein the spacing between the first stripe and the second plate is less than 2 mm.

9. The multi-band antenna of claim 1, wherein the spacing between the second stripe and the third stripe is less than 2 mm.

10. The multi-band antenna of claim 1, wherein the spacing between the first metal foil and the second metal foil is less than 2 mm.

11. The multi-band antenna of claim 1, wherein the first metal foil and the second metal foils are made of copper.

12. The multi-band antenna of claim 1, wherein the thickness of the first metal foil and the second metal foil is between 0.025–0.03 mm.

13. The multi-band antenna of claim 1, wherein the thickness of the dielectric plate is between 0.3–0.5 mm.

14. The multi-band antenna of claim 1, wherein the dielectric plate is made of glass fiber.

15. The multi-band antenna of claim 1, wherein the dielectric constant of the dielectric plate is between 1 to 4.55.

16. A multi-band antenna having a first frequency and a second frequency substantially lower than the first frequency, the multi-band antenna comprising:

a dielectric plate;

a first metal foil disposed on a surface of the dielectric plate, comprising a first plate and two first stripes, wherein the length of each first stripe is equivalent to one fourth wavelength of the first frequency, the length from the first plate to the end one of the first stripes is equivalent to one fourth wavelength of the second frequency, and the first plate and the two first stripes are in an electrically insulating state when the first frequency is in use, the first plate and the two first stripes are in an electrical connecting state when the second frequency is in use; and a second metal foil disposed on the surface of the dielectric plate and spaced at a distance to the first metal foil, the second metal foil including a second stripe and a third stripe connected to the second stripe, wherein the length of the second stripe is equivalent to one fourth wavelength of the second frequency, the length of the third stripe is equivalent to one fourth wavelength of the first frequency.

17. The multi-band antenna of claim 16, wherein the thickness of the dielectric plate is between 0.3–0.5 mm.

18. The multi-band antenna of claim 16, wherein the first frequency is within ISM 5 GHz band, and the second frequency is within ISM 2.4 GHz band.

19. The multi-band antenna of claim 16, wherein the first plate and the two first stripes are connected by a connecting bar whose width is less than 1 mm, and the connecting bar is in an electrically open state when the first frequency is in use.

* * * * *